US006685292B2

(12) United States Patent
Oshima

(10) Patent No.: US 6,685,292 B2
(45) Date of Patent: Feb. 3, 2004

(54) PRINTING APPARATUS AND PRINTHEAD CHARACTERISTIC DATA SELECTION METHOD

(75) Inventor: Masato Oshima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 10/082,279

(22) Filed: Feb. 26, 2002

(65) Prior Publication Data

US 2002/0158934 A1 Oct. 31, 2002

(30) Foreign Application Priority Data

Feb. 28, 2001 (JP) ..... 2001-055650

(51) Int. Cl.[7] ..... B41J 29/38; B41J 29/393
(52) U.S. Cl. ..... 347/14; 347/19
(58) Field of Search ..... 347/14, 19; 400/120.11, 400/708, 120.09, 120.1–120.17

(56) References Cited

U.S. PATENT DOCUMENTS 5,488,223 A * 1/1996 Austin et al. ..... 400/120.09
6,126,266 A 10/2000 Numata et al. ..... 347/23

FOREIGN PATENT DOCUMENTS

EP 0 863 003 9/1998 ..... B41J/2/01
EP 0 941 851 9/1999 ..... B41J/2/01
EP 1 004 447 5/2000 ..... B41J/2/175

OTHER PUBLICATIONS

European Search Report, dated Jul. 29, 2002, in EP Application No. 33964.

* cited by examiner

*Primary Examiner*—Juanita Stephens
(74) *Attorney, Agent, or Firm*—Fitzpatrick, Cella, Harper & Scinto

(57) ABSTRACT

Printing apparatus and printhead characteristic data selection method, which can appropriately handle printhead characteristic data under various environments. Judgment is made as to whether or not characteristic data of a printhead mounted to a printing apparatus is stored in an EEPROM of the printhead, an EEPROM of the printing apparatus, or a host computer. Based on the judgment result, the printhead characteristic data is inputted from the memory or host in accordance with a predetermined priority order. Validity of the characteristic data is determined each time the printhead characteristic data is inputted in accordance with the predetermined priority order. Based on the judgment result or determination result, the printhead characteristic data or average printhead characteristic data stored in another storage medium provided in the printing apparatus is selected.

13 Claims, 4 Drawing Sheets

PRINTING APPARATUS AND PRINTHEAD CHARACTERISTIC DATA SELECTION METHOD

FIELD OF THE INVENTION

This invention relates to a printing apparatus and a printhead characteristic data selection method and, more particularly, to a printing apparatus having, e.g., an inkjet printhead, and a printhead characteristic data selection method.

BACKGROUND OF THE INVENTION

As is already well known, an inkjet printhead (hereinafter referred to as a printhead) has a construction such that a plurality of ink discharge nozzles (hereinafter referred to as nozzles) are arranged at a constant density.

When printing, particularly halftone image printing, is performed with a printhead of this type, density unevenness might occur in a printed image due to an uneven amount of ink discharged from each of the nozzles, or uneven adhered positions of ink droplets discharged on a print medium.

Such density unevenness results from different printing characteristics of each printhead. In order to improve printing quality, it is necessary to reflect printing characteristic data, corresponding to each printhead, to printing operation. In view of this, a conventional printhead includes a non-volatile memory (e.g., EEPROM or the like) for storing characteristic data unique to each printhead, so that when the printhead is mounted on a printing apparatus, the characteristic data is read out of the memory by the printing apparatus.

However, a printhead having a non-volatile memory raises a problem of a high cost compared to a printhead not having a non-volatile memory.

To cope with this problem, conventionally, in a printing apparatus which no longer requires exchange of a deteriorated printhead by virtue of improved performance of a printhead, the characteristic data is stored not in a printhead, but in a non-volatile memory (EEPROM or the like) of the printing apparatus main unit so as to eliminate a storage medium from the printhead, thereby preventing an increased cost of the printhead.

However, in this case, unlike the structure in which the characteristic data is stored only in a printhead, there are various places or combinations of places to store the characteristic data, e.g., in a printing apparatus main unit, host computer, printing apparatus main unit and host computer, printhead and printing apparatus main unit, or the like. The most appropriate way of handling the printhead characteristic data still leaves a room for further improvement.

SUMMARY OF THE INVENTION

Accordingly, it is an object of the present invention to provide a printing apparatus and printhead characteristic data selection method, which can appropriately handle printhead characteristic data under various environments.

According to one aspect of the present invention, the foregoing object is attained by providing a printing apparatus comprising: judgment means for judging whether or not there is at least one medium or external device which stores characteristic data of a printhead; input means for inputting the characteristic data of the printhead from the at least one medium or external device in accordance with a predetermined priority order, based on a judgment result of the judgment means; storage means for storing the characteristic data; and printing means for performing printing by driving the mounted printhead with use of the characteristic data inputted by the input means or stored in the storage means.

The above-described apparatus may further comprise determination means for determining validity of the characteristic data each time the characteristic data of the printhead is inputted by the input means in accordance with the predetermined priority order.

The above-described apparatus may further comprise selection means for selecting one of the characteristic data of the mounted printhead or average printhead characteristic data stored in the storage means, based on the judgment result of the judgment means or determination result of the determination means.

Herein, the at least one medium or external device is a non-volatile memory of the printhead, host computer, or non-volatile memory of the printing apparatus.

Further, (1) in a case where the characteristic data of the mounted printhead is stored in all of the non-volatile memory of the printhead, host computer, and non-volatile memory of the printing apparatus, a first rank is assigned to the non-volatile memory of the printhead, a second rank is assigned to the non-volatile memory of the printing apparatus, and a third rank is assigned to the host computer as the predetermined priority order; whereas (2) in a case where the characteristic data of the mounted printhead is stored in the non-volatile memory of the printhead and non-volatile memory of the printing apparatus, a first rank is assigned to the non-volatile memory of the printhead and a second rank is assigned to the non-volatile memory of the printing apparatus as the predetermined priority order.

Furthermore, (1) in a case where the judgment means judges that the characteristic data of the printhead is not stored in any of the printhead, host computer, or non-volatile memory of the printing apparatus, or (2) in a case where the determination means determines that the characteristic data of the printhead is invalid, the selection means selects the average printhead characteristic data stored in the storage means.

The aforementioned printhead is an inkjet printhead, which performs printing by discharging ink, and preferably comprises an electrothermal transducer, which generates heat energy to be applied to ink, for discharging ink by utilizing the heat energy.

Furthermore, the aforementioned non-volatile memory includes EEPROM or the like.

According to another aspect of the present invention, the foregoing object is attained by providing a method of selecting characteristic data of a printhead comprising the steps of: judging whether or not there is at least one medium or external device which stores characteristic data of a printhead mounted to a printing apparatus; and inputting the characteristic data of the printhead from the at least one medium or external device in accordance with a predetermined priority order, based on a judgment result at the judgment step.

The above-described method may further comprise the step of determining validity of the characteristic data each time the characteristic data of the printhead is inputted at the input step in accordance with the predetermined priority order.

The above-described method may further comprise the step of selecting one of the characteristic data of the printhead or average printhead characteristic data stored in a storage medium provided in the printing apparatus, based on the judgment result at the judgment step or determination result at the determination step.

In accordance with the present invention as described above, judgment is made as to whether or not there is at least one medium or external device which stores characteristic data of a printhead mounted to a printing apparatus; the printhead characteristic data is inputted from the at least one medium or external device in accordance with a predetermined priority order based on the judgment result; validity of the characteristic data is determined each time the printhead characteristic data is inputted in accordance with the predetermined priority order; and selection is made from the printhead characteristic data and average printhead characteristic data, stored in a storage medium provided in the printing apparatus, based on the judgment result or determination result.

The invention is particularly advantageous since most appropriate printing operation can be performed by acquiring printhead characteristic data most appropriate for a current condition regardless of where the printhead characteristic data is stored.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

<Brief Description of Apparatus Main Unit>

Figure 1:
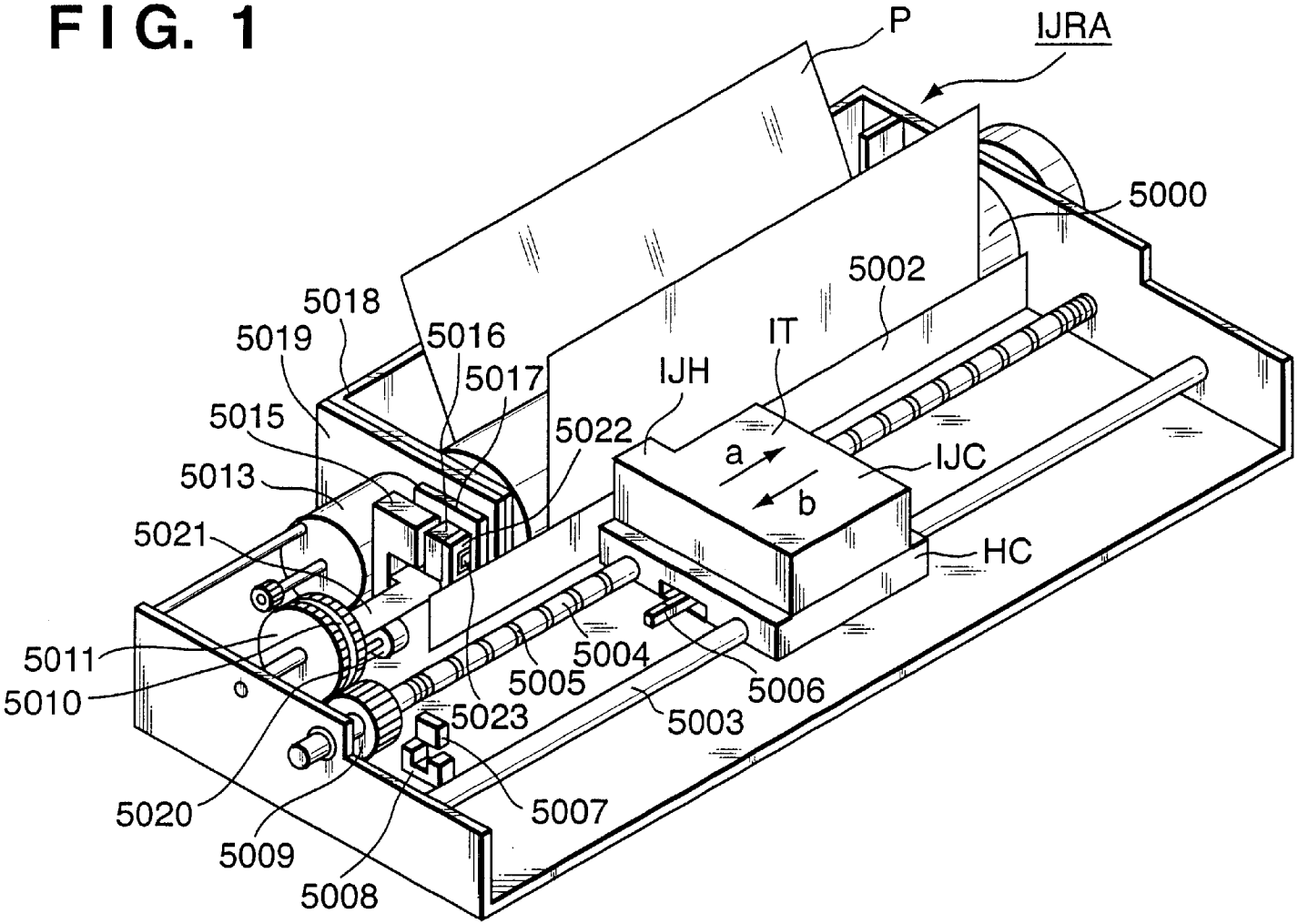
FIG. 1 is a perspective view showing an outer appearance of an ink-jet printer IJRA as a typical embodiment of the present invention.

FIG. 1 is a perspective view showing the outer appearance of an ink-jet printer 20 (hereinafter referred to as a printer) as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC, having a pin (not shown) and supported by a guide rail 5003, is reciprocally scanned in the directions of arrows a and b in FIG. 1. An integrated ink-jet cartridge IJC which incorporates a printhead IJH and an ink tank IT is mounted on the carriage HC. Reference numeral 5002 denotes a sheet pressing plate, which presses a paper sheet P against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

<Description of Control Construction>

Next, a control construction for performing a printing control in the above apparatus will be described.

Figure 2:
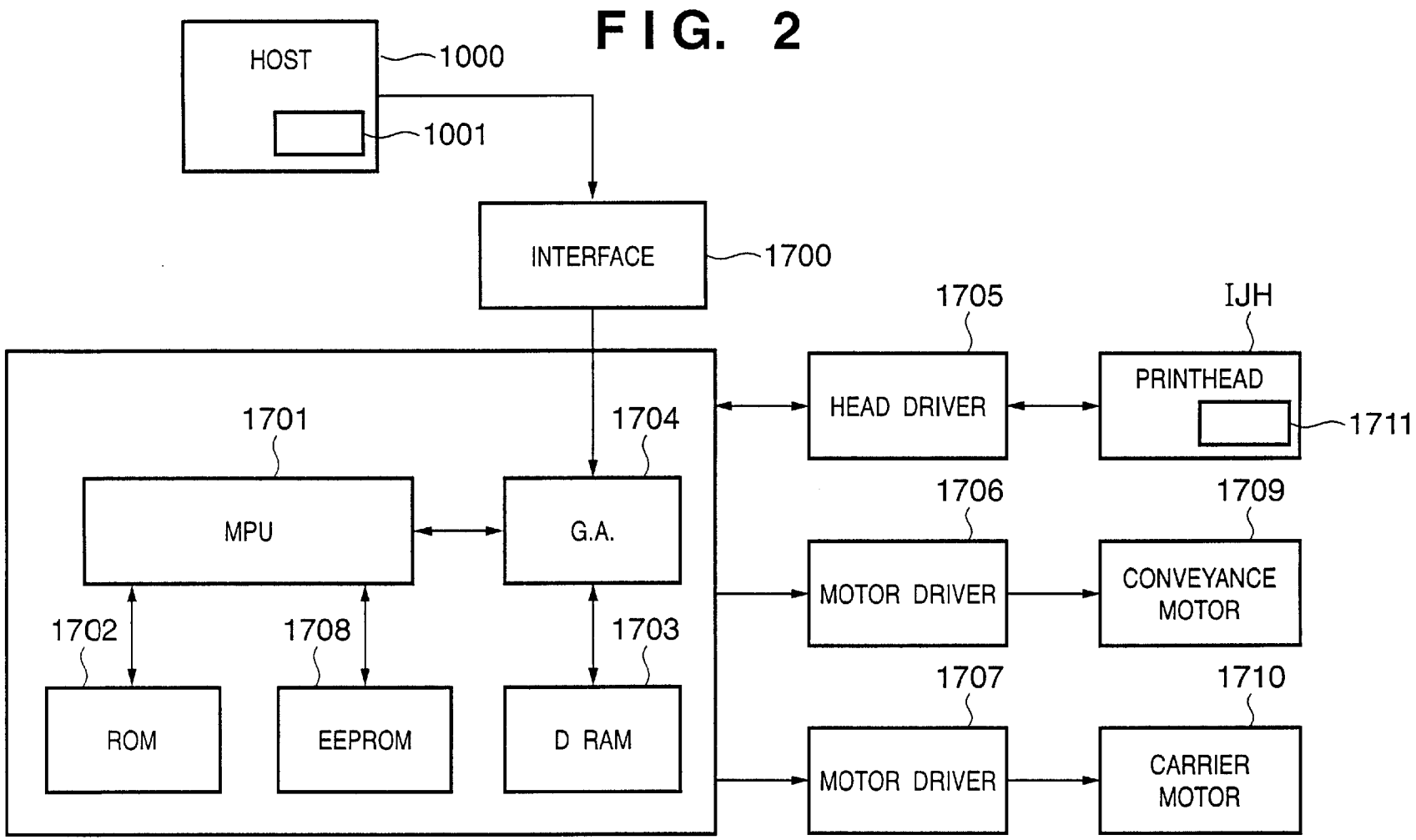
FIG. 2 is a block diagram showing an arrangement of a control circuit of the inkjet printer.

FIG. 2 is a block diagram showing the arrangement of a control circuit of the printer 20. Referring to FIG. 2 showing the control circuit, reference numeral 1700 denotes an USB interface for inputting a printing signal from a personal computer 1000 (hereinafter referred to as a host); 1701, an MPU; 1702, a programmable ROM for storing a control program executed by the MPU 1701 and necessary control data; and 1703, a DRAM for storing various data (the printing signal, printing data supplied to the printhead IJH, and the like). Reference numeral 1704 denotes a gate array (G.A.) for performing supply control of printing data to the printhead IJH. The gate array 1704 also performs data transfer control among the interface 1700, the MPU 1701, and the DRAM 1703. Reference numeral 1710 denotes a carrier motor for carrying the printhead IJH; and 1709, a conveyance motor for conveying a printing medium (e.g. a printing sheet). Reference numeral 1705 denotes a head driver for driving the printhead IJH; and 1706 and 1707, motor drivers for driving the conveyance motor 1709 and the carrier motor 1710.

The ROM 1702 also stores average characteristic data of a printhead.

Reference numeral 1708 denotes a non-volatile memory (e.g., EEPROM, FeRAM, MRAM or the like) for storing printhead characteristic data, in addition to a serial number, operation state, various correction data of a printing apparatus, and so forth.

The above-mentioned control construction is now described. When printing data is inputted to the interface 1700, the printing data is converted to a printing signal between the gate array 1704 and MPU 1701. While the motor drivers 1706 and 1707 are driven, the printhead IJH is driven in accordance with the printing data transmitted to the head driver 1705, and printing is performed.

Note that the ink tank IT and printhead IJH may be provided integrally to form the exchangeable ink cartridge IJC as mentioned above, or the ink tank IT and printhead IJH may be provided separably to enable exchange of the ink tank IT in a case where ink is exhausted.

In place of the USB interface 1700, an interface employing other standards, e.g., a Centronics interface, IEEE1284-compliant interface or the like, may be used.

Furthermore, the printhead characteristic data can be stored in a storage medium 1001, e.g., RAM, hard disk or the like, of the host 1000. Moreover, the printhead IJH includes a non-volatile memory (e.g., EEPROM, FeRAM, MRAM or the like) storing the printhead characteristic data. Note that the printhead IJH mounted to the printing apparatus is exchangeable with a printhead not including a non-volatile memory for performing printing.

Figure 3:
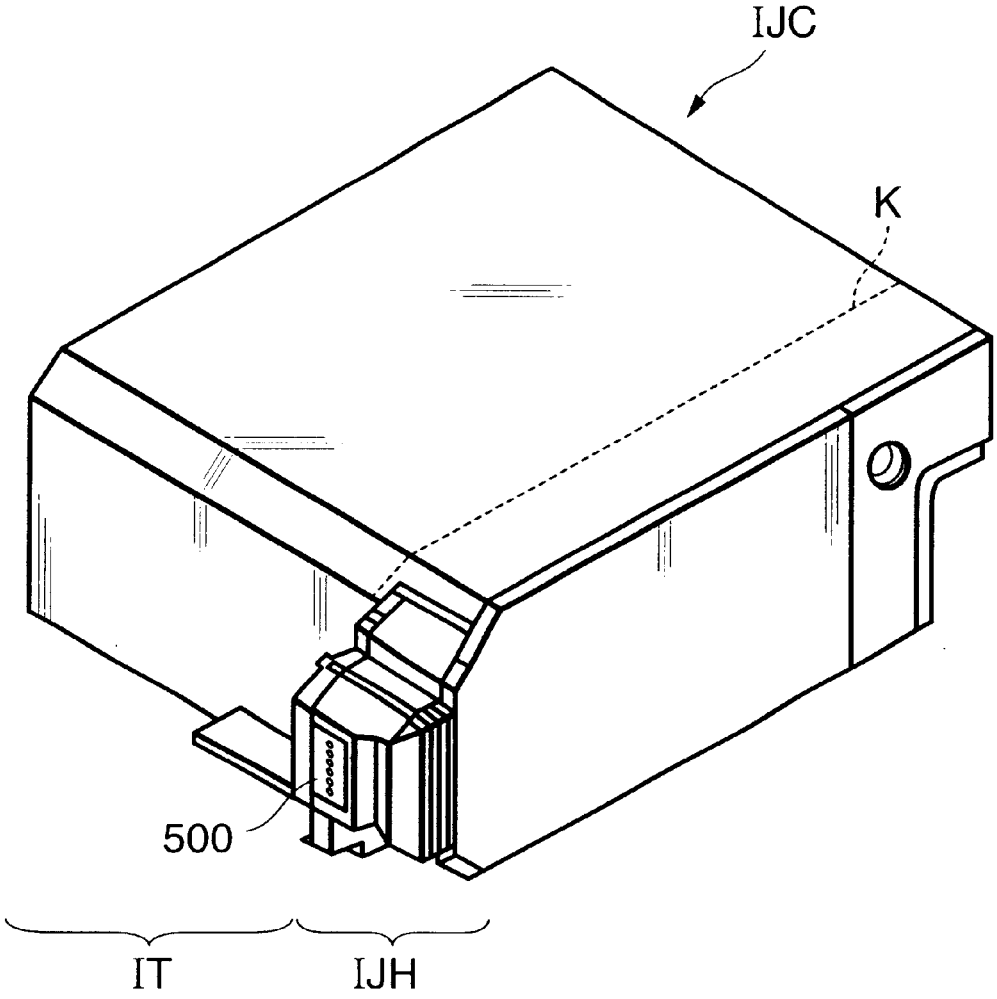
FIG. 3 is a perspective view showing a structure of an ink cartridge IJC in which an ink tank and printhead are separable.

FIG. 3 is a perspective view showing the structure of an ink cartridge IJC in which an ink tank and printhead are separable. As shown in FIG. 3, in the ink cartridge IJC, an ink tank IT and printhead IJH are separable at the position of a boundary line K. The ink cartridge IJC has electrodes (not shown) for receiving an electrical signal supplied from the carriage HC when it is mounted on a carriage HC. This electrical signal drives the printhead IJH to discharge ink, as described above.

Note that reference numeral 500 in FIG. 3 denotes an ink discharge port array. The ink tank IT has a fibrous or porous ink absorber for holding ink, and the ink absorber holds ink.

In the printing apparatus having the above-described configuration, the MPU 1701 can acquire the printhead characteristic data from at least one of the host, non-volatile memory of the printing apparatus, and non-volatile memory of the printhead. In the case where the printhead characteristic data can be acquired from a plurality of data sources, the data can be acquired selectively.

According to this embodiment, characteristic data acquisition processing shown in Table 1 is possible in accordance with an environment of the host connected with the printing apparatus, type of printhead mounted to the printing apparatus, and data stored in the non-volatile memory of the printing apparatus.

TABLE 1

| MPU processing | characteristic data stored in host? | characteristic data stored in printhead? | characteristic data stored in printing apparatus? |
|---|---|---|---|
| Selection is made from 3 data sources in the order of printhead, printing apparatus, and host | Yes | Yes | Yes |
| Selection is made from 2 data sources, with a priority to use characteristic data stored in printhead | No | Yes | Yes |
| Determine validity of data stored in non-volatile memory of printing apparatus | No | No | Yes |
| Determine validity of data stored in non-volatile memory of printhead | No | Yes | No |
| Determine validity of characteristic data stored in host | Yes | No | No |
| Use average printhead characteristic data in ROM | No | No | No |

Figure 4:
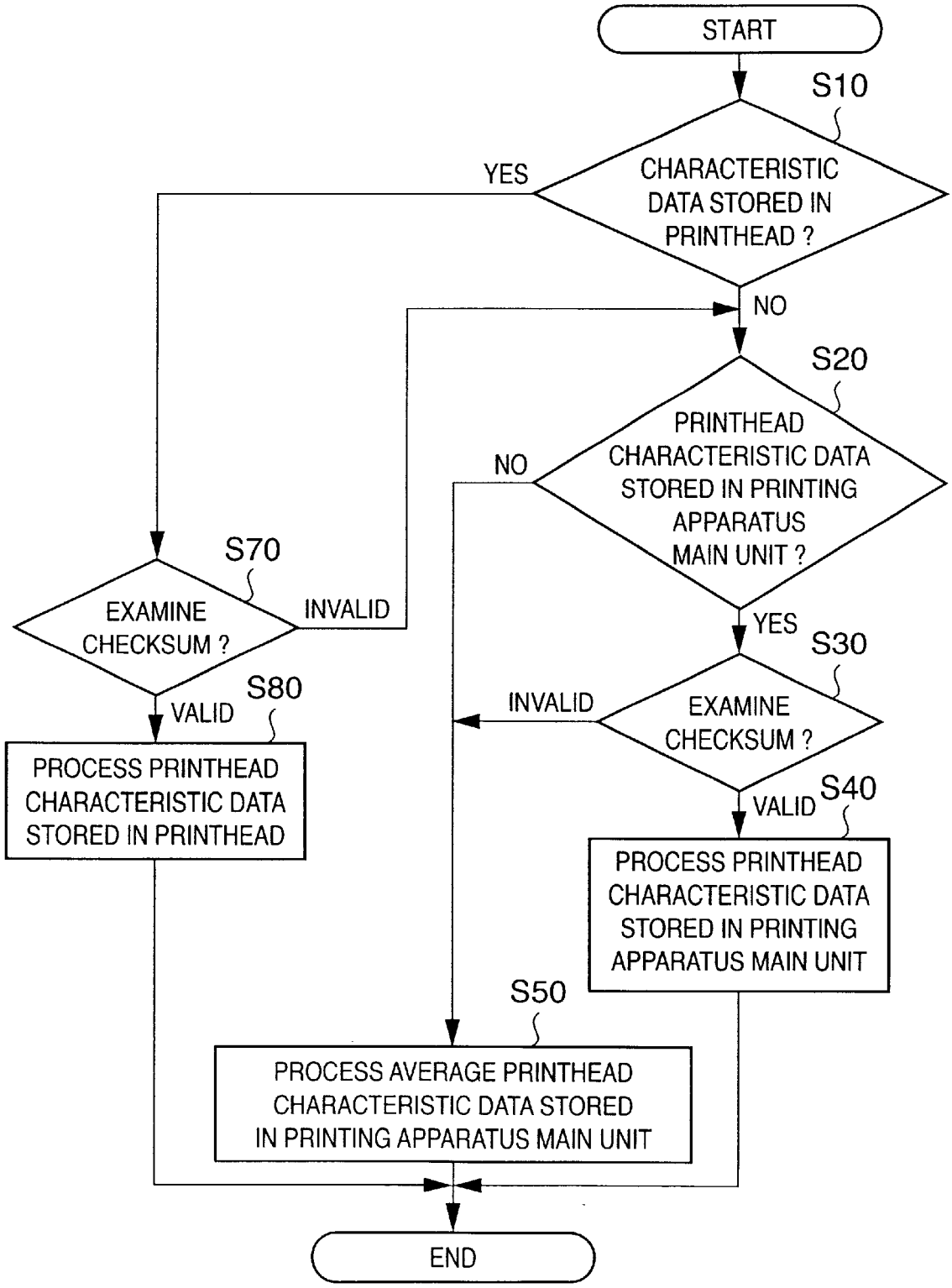
FIG. 4 is a flowchart describing printhead characteristic data acquisition processing.

Hereinafter, an example of printhead characteristic data acquisition method is described with reference to the flowchart in FIG. 4. The present embodiment assumes the second case in Table 1, in which the characteristic data is stored in the printhead and printing apparatus, and the acquisition priority order is set before executing the characteristic data acquisition processing. Herein, the first rank of the priority order is assigned to the printhead, and the second rank is assigned to the printing apparatus.

At step S10, it is determined whether or not characteristic data is stored in the printhead having the first rank of the priority order. This is realized by, for instance, the following process. A printhead, comprising EEPROM, has an output terminal of the EEPROM. The carriage HC of the printing apparatus has a contact point to electrically be connected with the output terminal. The printing apparatus detects an existence of EEPROM by determining whether or not the contact point is electrically open. Accordingly, it is possible to determine whether or not the characteristic data can be inputted.

In a case where the printhead comprises EEPROM where data can be inputted, the control proceeds to step S70 where the data's checksum is examined for determining validity of the data. If the data is determined valid, the control proceeds to step S80 where the characteristic data inputted from the printhead is adopted as valid data. Then, the control ends. Meanwhile, if the data is determined invalid, the control proceeds to step S20.

Meanwhile, in a case where the characteristic data cannot be acquired from the printhead at step S10, the control also proceeds to step S20.

At step S20, it is determined whether or not the non-volatile memory of the printing apparatus stores the characteristic data of the printhead mounted to the printing apparatus. This is realized by, for instance, the following process. When a printhead is mounted to the printing apparatus, unique data, e.g., a serial number of the printhead or the like, is inputted from the host connected to the printing apparatus so as to inform the printing apparatus of the unique data via the interface 1700, or the printing apparatus recognizes the type of printhead mounted thereto based on a combination of connections between the printhead's electric contact point and carriage HC's electric contact point. The obtained unique data of the printhead or the type of printhead is used as a key to determine whether or not the non-volatile memory 1708 stores the corresponding characteristic data.

Alternatively, various characteristic data may be stored in the form of LUT in the non-volatile memory 1708, and the most appropriate characteristic data for the printhead may be selected by inputting a rank of the mounted printhead from the host. Note that the rank of the printhead may be embossed on a printhead body, or written on a packaging case of the printhead or in an instruction manual. As long as information that can be inputted from the host is provided, the rank data can be acquired by any method.

When it is determined that the printing apparatus stores the corresponding characteristic data, the control proceeds to step S30 where the data's checksum is examined for determining validity of the data. If the data is determined valid, the control proceeds to step S40 where the characteristic data stored in the printing apparatus is adopted as valid data. Then, the control ends. Meanwhile, if the data is determined invalid, the control proceeds to step S50.

Meanwhile, in a case where the characteristic data cannot be acquired from the printing apparatus at step S20, the control also proceeds to step S50.

At step S50, average characteristic data of a printhead, which is stored in advance in the ROM 1702 of the printing apparatus, is adopted.

As has been described above, according to the foregoing embodiment, by virtue of predetermining the priority order of characteristic data acquisition, printhead characteristic data can be acquired appropriately regardless of where the characteristic data is stored, and printing control can be performed in accordance with the acquired characteristic data. Accordingly, it is possible to realize a printing system having flexibility and diversity in terms of printhead characteristic data acquisition.

Furthermore, even in a case where appropriate characteristic data of the printhead mounted is not stored anywhere or cannot be acquired, the best possible printing is performed with the use of average characteristic data stored in advance.

In the above embodiment, a step where control is made based on a result of whether characteristic data is stored in a printhead or in a printing apparatus is described. However, this invention is not limited to this. As described, in a case where a host computer stores characteristic data, the characteristic data in the host computer is handled as a third ranking data followed by the characteristic data in the printing apparatus.

Still further, by virtue of the printing apparatus of this embodiment, even in a case where a printhead not having a non-volatile memory, e.g., EEPROM or the like, which is mounted to the printing apparatus at the time of shipping, is exchanged due to failure with a printhead having a non-volatile memory storing the printhead characteristic data, it is possible to provide the printing apparatus with appropriate characteristic data with ease.

In the description of the above embodiment, a liquid droplet discharged from the printhead is ink, and the liquid stored in the ink tank is also ink. However, the liquid stored in the ink tank is not limited to ink. For example, the ink tank may store a processed liquid to be discharged onto a print medium so as to improve fixability and water repellency of a printed image or to improve its image quality.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, not only a cartridge type printhead in which an ink tank is integrally arranged on the printhead itself but also an exchangeable chip type printhead, as described in the above embodiment, which can be electrically connected to the apparatus main unit and can receive an ink from the apparatus main unit upon being mounted on the apparatus main unit can be applicable to the present invention.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program. In this case, the program codes read from the storage medium realize the functions according to the embodiments, and the storage medium storing the program codes constitutes the invention. Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus comprising:

judgment means for judging whether or not there is at least one medium or external device which stores characteristic data of a printhead;

input means for inputting the characteristic data of the printhead from the at least one medium or external device in accordance with a predetermined priority order, based on a judgment result of said judgment means;

storage means for storing the characteristic data; and printing means for performing printing by driving the mounted printhead with use of the characteristic data inputted by said input means or stored in said storage means.

2. The apparatus according to claim 1, further comprising determination means for determining validity of the characteristic data each time the characteristic data of the printhead is inputted by said input means in accordance with the predetermined priority order.

3. The apparatus according to claim 2, further comprising selection means for selecting one of the characteristic data of the mounted printhead or average printhead characteristic data stored in said storage means, based on the judgment result of said judgment means or determination result of said determination means.

4. The apparatus according to claim 3, wherein in a case where said judgment means judges that the characteristic data of the printhead is not stored in any of the printhead, a host computer, or a non-volatile memory of the printing apparatus, or in a case where said determination means determines that the characteristic data of the printhead is invalid, said selection means selects the average printhead characteristic data stored in said storage means.

5. The apparatus according to claim 1, wherein the at least one medium or external device is a non-volatile memory of the printhead, host computer, or non-volatile memory of the printing apparatus.

6. The apparatus according to claim 5, wherein in a case where the characteristic data of the mounted printhead is stored in all of the non-volatile memory of the mounted printhead, a host computer, and the non-volatile memory of the printing apparatus, a first rank is assigned to the non-volatile memory of the printhead, a second rank is assigned to the non-volatile memory of the printing apparatus, and a third rank is assigned to the host computer as the predetermined priority order.

7. The apparatus according to claim 5, wherein in a case where the characteristic data of the mounted printhead is stored in the non-volatile memory of the printhead and the non-volatile memory of the printing apparatus, a first rank is assigned to the non-volatile memory of the printhead and a second rank is assigned to the non-volatile memory of the printing apparatus as the predetermined priority order.

8. The apparatus according to claim 5, wherein the non-volatile memory includes EEPROM.

9. The apparatus according to claim 1, wherein said printhead is an inkjet printhead which performs printing by discharging ink.

10. The apparatus according to claim 9, wherein the inkjet printhead comprises an electrothermal transducer, which generates heat energy to be applied to ink, for discharging ink by utilizing the heat energy.

11. A method of selecting characteristic data of a printhead comprising the steps of:

judging whether or not there is at least one medium or external device which stores characteristic data of a printhead mounted to a printing apparatus; and inputting the characteristic data of the printhead from the at least one medium or external device in accordance with a predetermined priority order, based on a judgment result at said judgment step.

12. The method according to claim 11, further comprising the step of determining validity of the characteristic data each time the characteristic data of the printhead is inputted at said input step in accordance with the predetermined priority order.

13. The method according to claim 12, further comprising the step of selecting one of the characteristic data of the printhead or average printhead characteristic data stored in a storage medium provided in the printing apparatus, based on the judgment result at said judgment step or determination result at said determination step.

* * * * *